US005674309A

United States Patent [19]

Riley

[11] Patent Number: 5,674,309

[45] Date of Patent: Oct. 7, 1997

[54] METHOD AND APPARATUS FOR CONTROLLED TURBULENT PURGING OF OPEN CONTAINERS

[75] Inventor: Michael Francis Riley, Danbury, Conn.

[73] Assignee: Praxair Technology, Inc., Danbury, Conn.

[21] Appl. No.: 531,675

[22] Filed: Sep. 21, 1995

[51] Int. Cl.[6] ..... C21B 7/16

[52] U.S. Cl. ..... 75/528; 266/47; 266/217; 266/207

[58] Field of Search ..... 266/216, 217, 266/207, 47, 265, 275; 75/528, 558, 709, 708, 553, 554

[56] References Cited

U.S. PATENT DOCUMENTS

| | | | |
|---|---|---|---|
| 1,315,206 | 9/1919 | Bristol | 75/709 |
| 4,298,187 | 11/1981 | Dantzig et al. | 266/217 |
| 4,448,616 | 5/1984 | Francis, Jr. et al. | 148/16 |
| 4,552,587 | 11/1985 | Nakashima et al. | 75/558 |
| 4,823,680 | 4/1989 | Nowotarski | 98/36 |
| 4,990,183 | 2/1991 | Anderson | 75/558 |
| 5,004,495 | 4/1991 | Labate | 75/528 |
| 5,183,498 | 2/1993 | Haun et al. | 75/709 |
| 5,195,888 | 3/1993 | Sharma et al. | 432/64 |
| 5,314,525 | 5/1994 | Eckert et al. | 75/528 |
| 5,366,409 | 11/1994 | Riley | 454/188 |

OTHER PUBLICATIONS

Argon Casting For Improving Steel Quality, M.F. Hoffman et al, Stainless Steel, pp. 375–386 Dec. 1960.

*Primary Examiner*—Scott Kastler
*Attorney, Agent, or Firm*—Stanley Ktorides

[57] ABSTRACT

A method and apparatus for purging air from the interior of a container in which purge gas is supplied to the interior of the container from one or more injectors in a turbulent jet flow having a modified Reynolds number Re' of less than 14,000 and the purge gas is supplied at a flow rate to produce a positive pressure within the container of at least $2\times10^{-8}$ atm above the ambient pressure.

5 Claims, 5 Drawing Sheets

METHOD AND APPARATUS FOR CONTROLLED TURBULENT PURGING OF OPEN CONTAINERS

FIELD OF THE INVENTION

The invention relates to a method and apparatus for purging air from an open container such as one used for processing metals, by using a purge gas applied to the container through injectors of simple and rugged construction located to minimize the aspiration of ambient air into the container.

BACKGROUND OF THE INVENTION

Many materials being processed must be kept under a controlled atmosphere to prevent explosion or to achieve required chemical composition and physical properties. For example, in the processing of metal, molten steel reacts with or dissolves oxygen from ambient air. This can cause oxidation of the chemical components of the steel and change its chemical composition resulting in unsatisfactory mechanical strength properties in the steel. Also, the oxides resulting from the reaction of the steel with the air can form inclusions which can ruin the physical appearance of the final product or lower its mechanical performance. Additionally, nitrogen dissolution in steel is increasingly becoming a concern on many important steel grades, for similar reasons. In either case, the overall result is lower yield of acceptable steel product. Therefore, it is desirable to purge air from the location in which the processing takes place.

Ideally, sensitive materials are processed in containers having dedicated chambers which can be evacuated of air and repressurized with an inert gas atmosphere. For large scale production of metals such as steel, however, this is generally not practical. The capital expense of dedicated chambers and vacuum equipment is usually not affordable for the large scale practice of commercial steelmaking. In addition, processing time is increased due to the added time spent in closing, evacuating, repressurizing, and re-opening the chamber. Further, additions of alloying elements and refining agents, or sampling for temperature or composition must also be done by remote action, adding time and expense to the process. These actions all are inconsistent with the rapid production rate required for a profitable steelmaking operation.

Practical steelmaking and other metal processing operations require process containers with one or more openings to the ambient atmosphere through which the metal, fluxes, alloying agents, lances, or probes are introduced and removed from the processing chamber of the container. Operators commonly try to prevent air infiltration into the container chamber by directing turbulent jets of inert gas into the container or across the container openings. These turbulent jets, however, entrain the gas (such as air) that surrounds them and cause the gas to be aspirated into the container through the opening. For example, R. H. Perry and C. H. Chilton, in Chemical Engineers' Handbook, 5th Ed., McGraw-Hill, 1973, page 5–20, show that an air jet, usually considered to be a turbulent flow, issuing into air of the same temperature entrains its own mass within a distance of three diameters of the outlet from which the gas jet originates. The result is that purging a chamber with an uncontrolled gas jet results in little, if any, lowering of the air content of the container chamber atmosphere.

Better purging results can be achieved when the purge gas is introduced into the container, or across the mouth of its opening, in a laminar, rather than a turbulent, flow. Examples of this technique are described in M. F. Hoffman et al., "Argon Casting For Improving Steel Quality", Proceedings of Electric Furnace Conference, 1960, AIME, 1961, pp. 375–386; M. S. Nowotarski, "Wide Laminar Fluid Doors", U.S. Pat. No. 4,823,680, Apr. 25, 1985; and S. K. Sharma et al., "Multi-Layer Fluid Curtains For Furnace Openings", U.S. Pat. No. 5,195,888, Mar. 23, 1993. The techniques in all of these publications require special gas diffuser devices which provide the needed volume flow rate of purge gas at a velocity that is low enough to generate laminar flow. These diffuser devices are bulky, expensive, and generally fragile. Fragility is a decided problem for diffusers made from porous metal or porous ceramic which have relatively low mechanical strength. Even minor damage to such a diffuser can induce enough turbulence into the gas flow to aspirate ambient air to flow into the container. Thus, in a steelmaking environment using heavy equipment, fragile diffusers have an unsuitably short working lifetime. Repair of diffusers is impossible or at best requires special equipment and expertise which may not be readily available in a steel works. Therefore, an inventory of expensive, special parts must be kept on hand or additional specialized labor must be trained and employed.

Also, because the laminar purge gas flow velocity is low, the equipment must be made very large in cross-section to provide a suitably high flow rate. Otherwise, purging will take a very long time, reducing productivity.

Devices such as those described by Nowotarski and by Sharma et al., supra, are slow to purge because the purge gas flow is across the container opening rather than into the container. With the laminar purge gas flow across the opening a significant fraction of the purge gas forms a barrier to air infiltration into the container. However, the purge gas does not enter the container to displace the original air volume. Thus, in large containers with relatively small openings, purge times can be quite high with these laminar flow devices.

OBJECTS OF THE INVENTION

An object of the invention is to provide a method and apparatus for effectively purging air from an open container.

An additional object is to provide a method and apparatus for effectively purging air from an open container for processing metal.

Another object is to provide a method and apparatus for supplying purge gas to the interior of an open container using injectors of simple pipe construction.

A further object is to provide a method and apparatus for effectively purging an open container of air by injecting a turbulent purge gas flow from one or more injectors located with respect to the container to produce a modified Reynolds number below a certain value and at a flow rate sufficient to produce a desired pressure within the container above a predetermined value.

Still another object is to provide a method and apparatus to purge an open container by supplying a turbulent purge gas flow from one or more injectors located to produce a modified Reynolds number of less than 14,000 and at a flow rate to produce a pressure in the container greater than $2\times10^{-8}$ atm above ambient.

BRIEF DESCRIPTION OF THE INVENTION

The invention purges a container of air by using one or more turbulent jets of the purge gas injected directly into the container. By isolating the ambient atmosphere from the jet's turbulent effects, aspiration of ambient air into the chamber is lowered to a value substantially lower than that expected for a turbulent jet. Isolation is effected by selecting a purge gas flow rate which creates a positive pressure within the container of at least $2\times10^{-8}$ atm above ambient. In addition, the one or more purge gas jet injectors have preferred specific locations relative to the container and certain specific dimensional relationships. That is, in accordance with the invention, the distance (L) from the center line of a purge gas jet to the nearest opening in the container is maximized, the distance (h) from the jet outlet to the nearest container wall, and the number of injectors and size of their respective outlets are selected to minimize the jet velocity (and thereby the dimensionless Reynolds number, Re) for the selected purge gas flow rate selected to achieve the desired container positive pressure so that the value of Re×h/L, referred to here as a modified Reynolds number Re', is less than 14,000.

The aspirating effects of the turbulence created by the purging gas jet(s) are controlled by the coordinated selection of the gas flow rate with the number, size, and position of the gas jet outlets so that the aspiration of ambient air is far less than that expected from the prior art use of turbulent gas jets for purging. In accordance with the invention, all of the purge gas volume is injected directly into the container and purge times are short. In a preferred embodiment, the purge gas is supplied up to the container using a pipe of relatively small diameter. A novel fitting is provided to expand the outlet of the purge gas injector to a desired diameter without aspirating air into the chamber.

BRIEF DESCRIPTION OF THE DRAWINGS

Other objects and advantages of the present invention will become more apparent upon reference to the following Specification and annexed drawings in which.

DETAILED DESCRIPTION OF THE INVENTION

Figure 4:
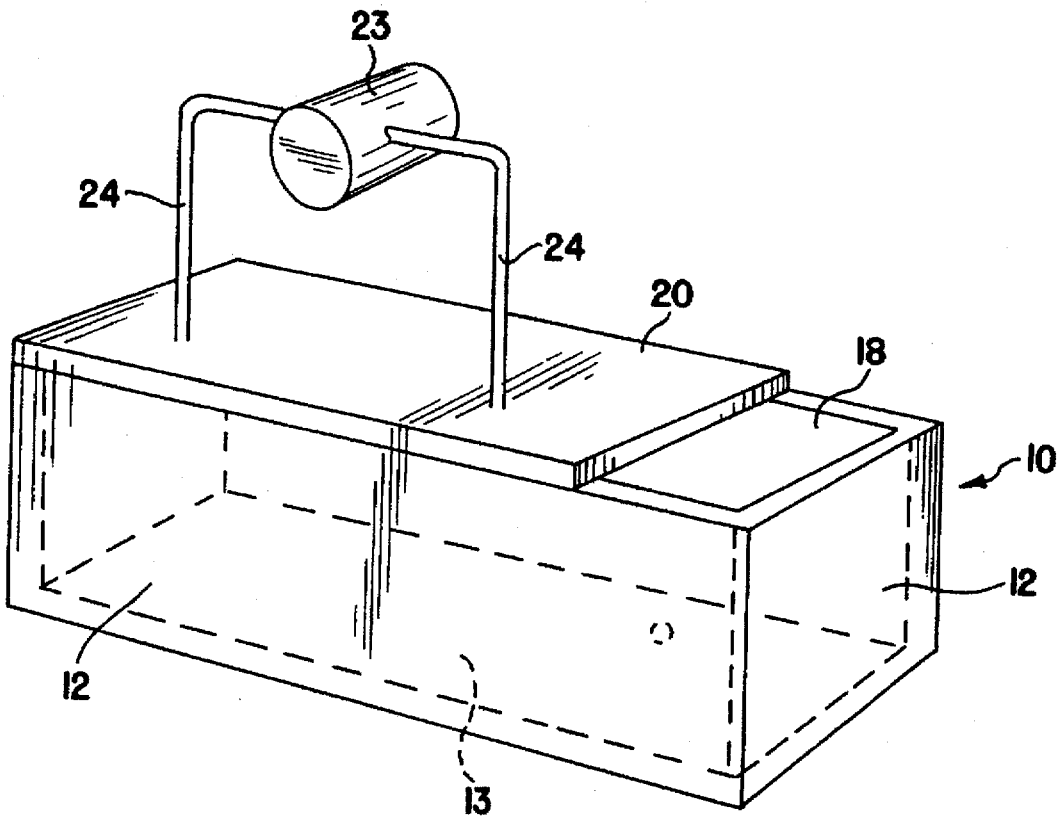
FIG. 4 is a perspective view of a tundish model demonstrating the principles of the invention.
Figure 4A:
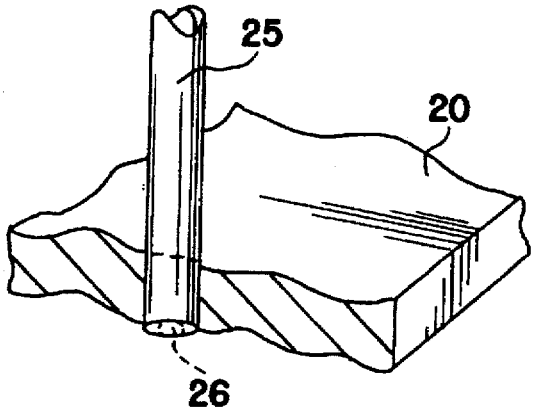
FIG. 4A is a cross-section view of a portion of the tundish cover of FIG. 4 showing a gas jet inlet.

FIGS. 4 and 4A depict a container and turbulent gas jet injector for purposes of explaining the invention. The container 10 is illustratively a tundish used in steelmaking, but the invention is applicable to other types of containers used in other types of processes. Container 10 has the usual vertical side walls 12 and bottom wall 13 which can be lined with a refractory material and an open top that is partially closed by a cover 20 to define an opening 18. The cover 20 is usually removed and replaced for installation and maintenance of the tundish refractory and for removing residual material from previous processing. During processing, the opening 18 is left uncovered so that there is communication between the interior of the container and the ambient environment, and processing materials can be added into and removed from the container.

One or more purge gas injectors 24 are provided in the cover 20 to supply purge gas from a source 23. An injector includes the end of a supply pipe 25 which is attached to the cover 20 at a through-hole 26 on the end of the pipe 25 and terminates at the lower surface of the cover. The opening at the bottom surface of the cover is the injector outlet. Several of the features of the invention to be considered relative to the purge gas injector are the diameter of the injector pipe to control the gas flow rate, the diameter of the gas jet entering the container as set by the injector outlet at the cover bottom surface and the distance of the injector outlet into the container from the nearest container vertical wall 12 with the gas jet flowing parallel to this wall. These features are explained J. M. Beer and N. A. Chigier, Combustion Aerodynamics, Applied Science Publishers, 1972, page 16, give a relationship between the mass of ambient gas entrained by a turbulent jet and the initial mass of the turbulent jet. Converting their mass relationship to a volume relationship gives $$\frac{Q_a}{Q_i} = 0.32\left(\frac{M_i}{M_a}\ \frac{T_i}{T_a}\right)^{1/2}\left(\frac{x}{d}\right)-1 \tag{1}$$

where:

$Q_a$ is the entrained volume of ambient gas, $Q_i$ is the initial jet volume, $M_i$ is the molecular weight of the jet gas, $M_a$ is the molecular weight of the ambient gas, $T_i$ is the temperature of the jet gas, $T_a$ is the temperature of the ambient gas, X is the axial distance from the jet outlet and d is the diameter of the jet outlet.

Thus, if an argon jet is discharged from an injector outlet into ambient air, both gases being at the same temperature, the jet will entrain its initial volume in ambient air within an axial distance of 2.6 outlet diameters from the gas jet outlet. At this point the jet will contain about 10.5% oxygen, since it will be a 50–50 mix of argon and air (20.9% oxygen). Thus it is difficult to obtain low oxygen levels in an open container using a turbulent jet alone.

A turbulent jet can successfully purge a container if the jet can be isolated from the ambient air while maintaining the container openings. Physical isolation can be accomplished by positioning the gas inlet far from the container openings. The air entraining effects of the gas jet can also be isolated from the ambient air by making the entraining length of the gas jet as short as possible. This can be done two ways. The gas jet can be aimed at a nearby wall of the container, so that the axial distance from the wall along the jet is minimized. Optionally, the gas jet can be positioned within 5 jet outlet diameters of a wall that runs approximately parallel to the jet axis. Since, according to R. H. Perry and C. H. Chilton, the gas jet will expand at a half-angle of 10 degrees, it will intersect a parallel wall that is within 5 jet outlet diameters of the jet. The half-angle is defined as the angle between the jet axis and the jet boundary. When the gas jet intersects a parallel wall of the container it tends to attach to that wall by the Coanda effect, greatly lowering entrainment of air by the jet.

To quantify the effects of these two isolating factors, distance of the injector gas jet outlet from the container opening and the entraining length of the jet, the volume of ambient air aspirated into a model steel works' tundish, such as shown in FIG. 4, and ladle were measured as a function of a modified jet Reynolds' number, Re', defined as:

$$Re' = \frac{Q_i}{ndv_{air}}\left(\frac{h}{L}\right) = Re\left(\frac{h}{L}\right) \quad (2)$$

where:

$Q_i$ is the jet volume flow rate, n is the number of jet outlets (injectors), d is the injector outlet diameter, $v_{air}$ is the kinematic viscosity of the ambient gas (air), h is the length of the jet, L is the distance from the jet outlet to the container opening. The quantity $Q_i/ndv_{air}$ has the form of a Reynolds number, which relates the relative strength of momentum effects and viscous effects.

Figure 1:
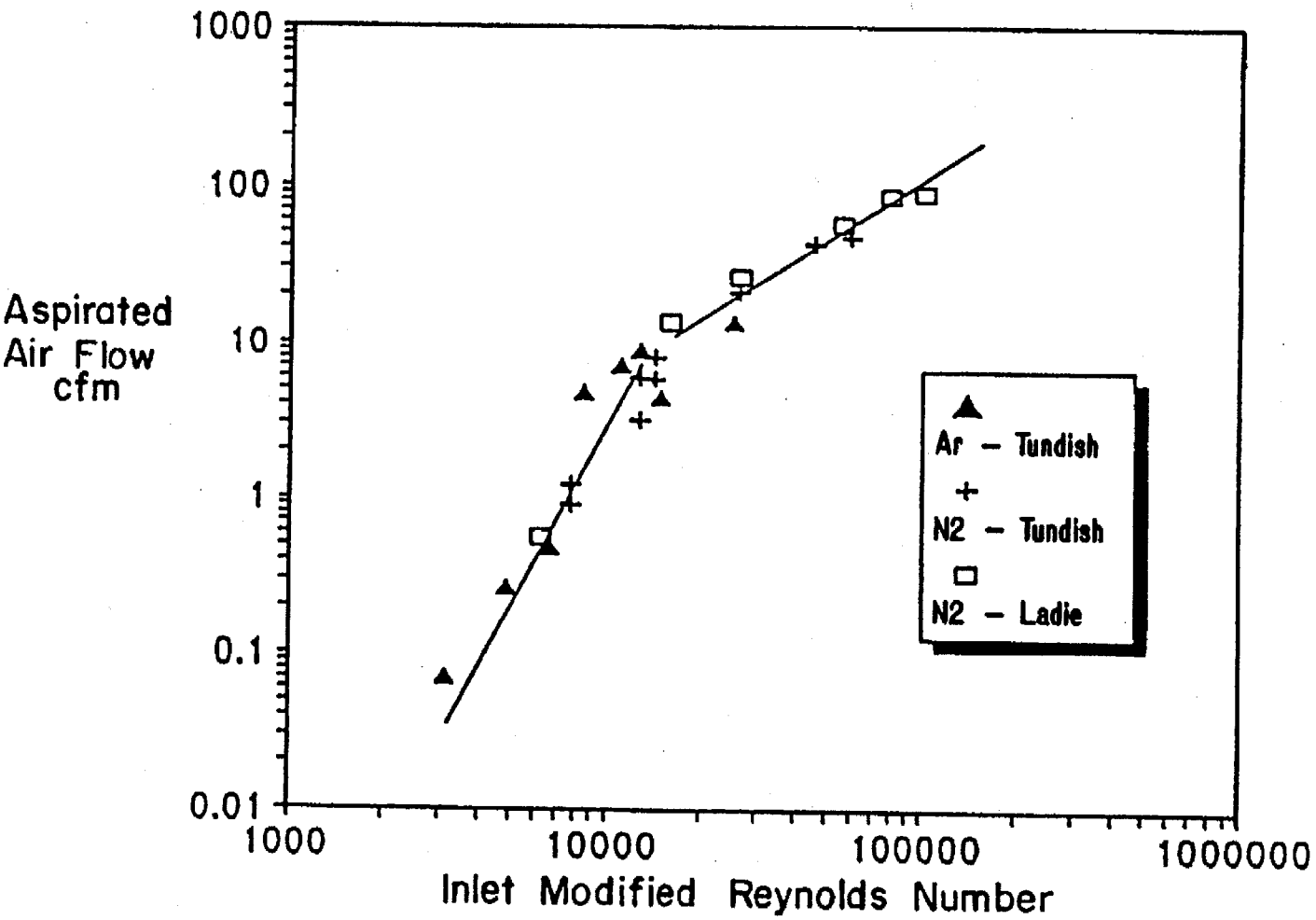
FIG. 1 is a graph showing the relationship between an aspirated air flow and a gas jet inlet in terms of a modified Reynolds number Re'.

The length of the jet, h, was taken to be the smaller of the following two values: the distance from the injector jet outlet to the opposite container wall or 5 times the distance from the injector outlet to the nearest wall of the container parallel to the jet axis. The purge gases were argon or nitrogen. FIG. 1 shows the results of tests carried out on models of a tundish (such as shown in FIGS. 4 and 4A) and ladle used in steel manufacturing where the container pressure was less than $2\times10^{-8}$ atm above ambient. As seen in FIG. 1, at Re'>14,000, the aspirated air flow volume carried into the container increases linearly with Re'. Since Re' is proportional to $Q_i$, this effect is consistent with the entrainment equation (1) above. However, at Re'<14,000, the volume of aspirated air is much less than expected, dropping at a somewhat exponential rate. Thus, while the purge gas jets were highly turbulent, the rate of aspiration of air was far less than expected for a turbulent jet when the modified Reynolds number, Re'<14,000.

The purge gas jet can be further isolated from the ambient when the purge gas flow rate is sufficiently high to maintain a pressure in the container of at least $2\times10^{-8}$ atm above ambient. When the gas velocities through the openings are relatively low, the flow rate necessary to maintain this pressure is determined from the ratio of the container cross-sectional area and the container opening cross-sectional area according to the energy balance for incompressible flow, given as $$Q_1 = \left(\frac{A_c^2 A_o^2}{(A_c^2 - A_o^2)}\right)^{1/2}\left(\frac{2\Delta P}{\rho}\right)^{1/2} \quad (3)$$

where:

$A_c$ is the container cross-sectional area, $A_o$ the container opening cross-sectional area, P is pressure, and ρ is the purge gas density.

Figure 2:
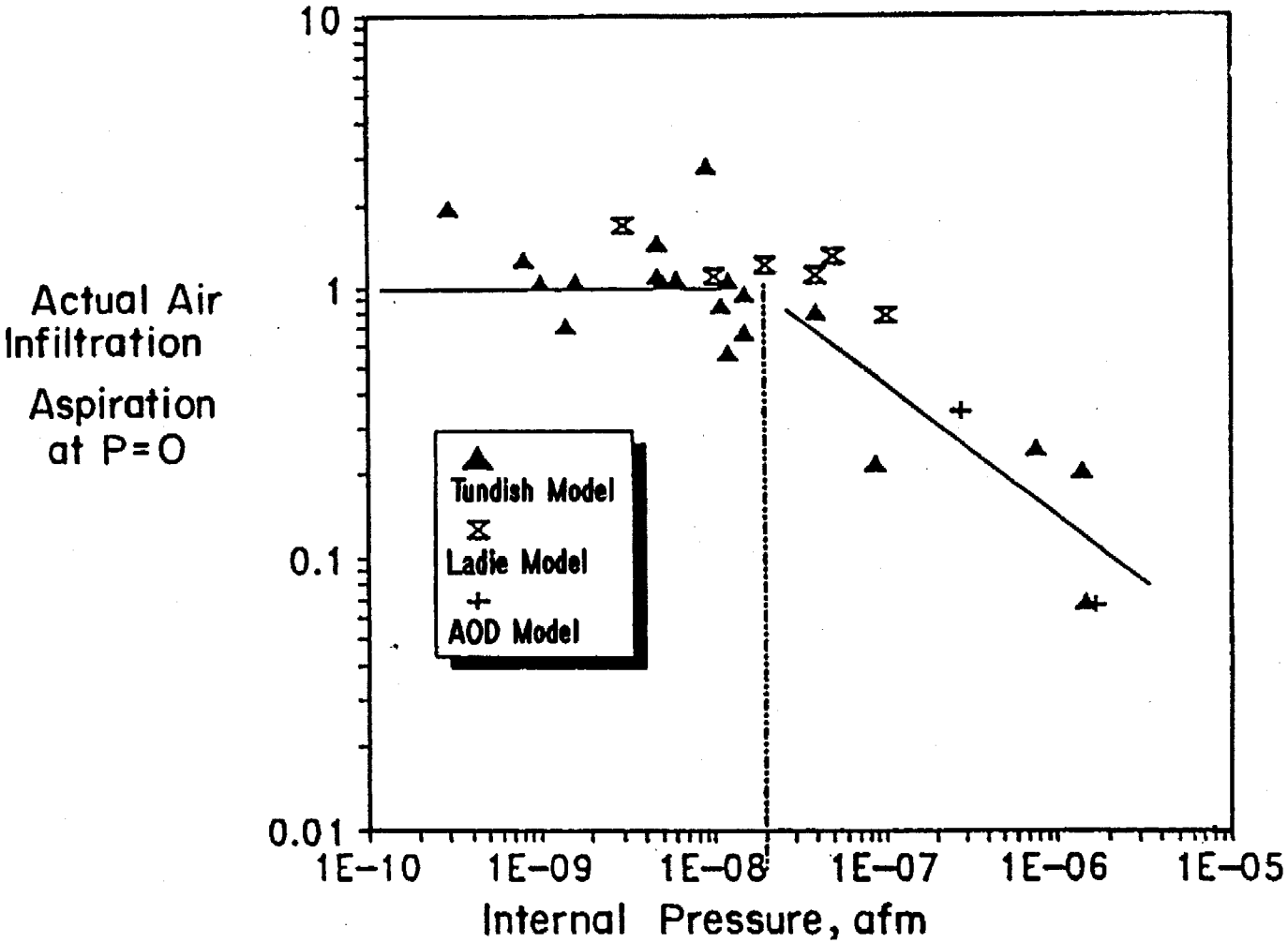
FIG. 2 is a graph showing the relationship between the internal pressure of the container and the volume of air aspirated into its chamber.

FIG. 2 shows the effect of the container internal pressure on the volume of ambient air aspirated into an open container. The data points represent the results of tests using nitrogen-helium mixtures to simulate hot purge gases in models of steel works tundishes, ladles, and AOD steelmaking vessels. The graph of FIG. 2 shows that when the container internal pressure is $2\times10^{-8}$ atm above ambient or greater, there is a rapid drop in the volume of ambient air infiltrating into these model containers relative to what would be expected from FIG. 1. Since this pressure represents the pressure created by a column of atmospheric air only 175 micrometers high, the effect of this pressure on air aspiration is unexpected.

To achieve the best results in practice, the isolation techniques of Re'<14,000 and container internal pressure of at least $2\times10^{-8}$ atmospheres are combined. To accomplish this, the geometry of the container must first be considered. For best efficiency, any unnecessary container openings should be closed or covered. The necessary openings should be reduced to the smallest practical size for successful operation of the process. Purge gas injection locations are selected, minimizing the length of the purge gas jets and maximizing the distance from the injector jet outlet to the remaining container openings.

Next, the proper purge gas flow rate must be selected. Two considerations are relevant for developing the correct purge gas flow rate. In practice, to maintain productivity there is usually only a short time available for purging air from the container. Typically, a turbulent purge jet will create a well-mixed atmosphere of air and purge gas within the container. Therefore, the total volume of purge gas needed to create the desired atmospheric purity can be calculated according to well-known equations for mixed flow reactors. A design purge gas flow rate can then be determined by dividing this calculated purge gas volume by the available purge time. From this purge gas flow rate and the size of the remaining openings in the container, it should be verified that the pressure in the container will be greater than the desired value of $2\times10^{-8}$ atm above ambient. If it is not, the purge gas flow rate should be increased. The purge time can be lowered accordingly to maintain the same total purge gas volume for purging. Finally, the number of purge gas injector sites and the diameter of the outlets is selected to ensure that Re'<14,000.

The above procedure is appropriate for systems where little or no buoyancy-driven flow of the purge gas occurs. However, when the container interior temperature is much higher than the ambient air, the purge gas will be heated, and buoyancy effects will tend to drive ambient air through the container opening into its interior. This rate of buoyancy-driven flow is additive to the rate of entrainment-driven flow caused by the gas jets. Therefore, a higher purge gas flow rate may be required. Buoyancy-driven flow also occurs when the molecular weight of the purge gas is less than that of the ambient gas, for example, when using helium to purge air from a container.

Tests show that the volume of ambient air forced into the container is related to the densities of the container atmosphere ρ density of the ambient atmosphere gas $\rho_a$; the height of the container H; the area of the openings $A_o$; and the actual flow rate of purge gas at its temperature in the container, $Q_{act}$. These variables are combined in dimensionless form as a Froude number, Fr, given as $$Fr = \frac{Q_{act}}{A_o}\sqrt{\frac{\rho}{(\rho_a - \rho)gH}} \quad (4)$$

Figure 3:
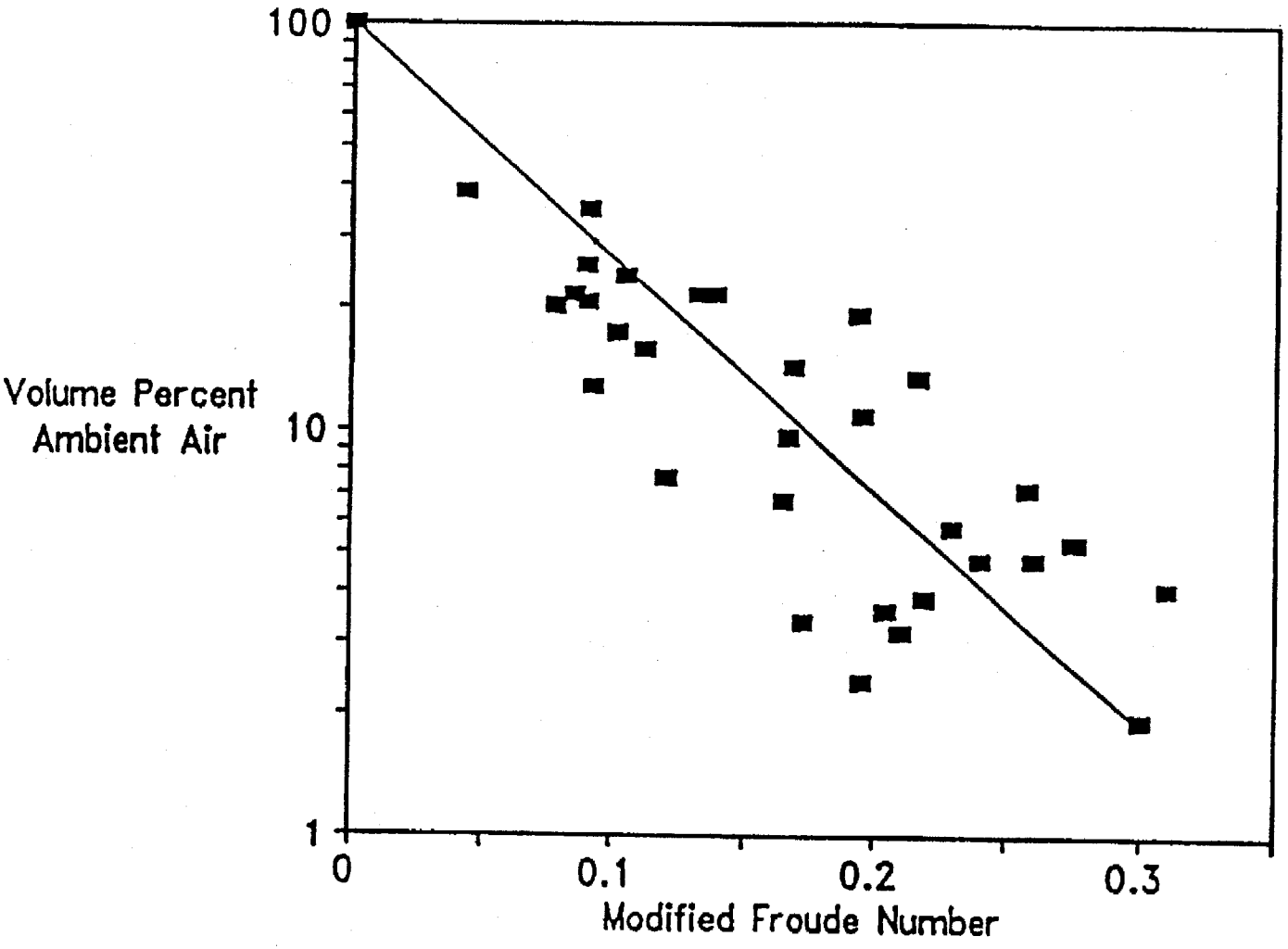
FIG. 3 is a graph showing the volume percent of ambient air forced into the container as a function of a modified Froude number.

The volume percent of ambient air in the container as a function of the Froude number is shown in FIG. 3.

Therefore, when the buoyant conditions occur in a container to be purged, it is also necessary to calculate the air infiltration caused by the buoyancy-driven flow using the data of FIG. 3. This should be compared with the flow rate needed to purge the container in the time allotted and the flow rate needed to maintain a pressure greater than $2\times10^{-8}$ atm above ambient in the container. The maximum flow rate of the three should be selected.

The following examples and comparative examples, summarized in Table 1, illustrate the operation and advantages of the invention.

EXAMPLE 1

A model steelmaking tundish, shown in FIG. 4, was purged with argon. The model represents one of two symmetrical halves of a 60-ton continuous caster tundish 10 at one-quarter scale. The tundish model is 3 ft. long by 1 ft. wide by 1 ft. deep. There is a single opening 18 in the top, 8 in. long by 12 in. wide that is left open by the cover 20. Argon was injected at 2.45 scfm through one injector 24 having an outlet, 0.19 inches in diameter, located 8 inches from the opening and 4 inches from the container interior side wall. The oxygen content in the container was measured through a probe (not shown) placed through the center of opening 18, 6 inches below the level of the bottom surface of the cover 20. Since the molecular weight of argon is greater than that of ambient air, there is no buoyancy-driven flow. The modified Reynolds number, Re', is 24,000 and the internal pressure is $2.7\times10^{-9}$ atm. This represents a practice outside the teaching of the invention in which Re'>14,000. A total argon flow of 15 scf passed into the model tundish, representing 5 times the volume of the model tundish. The oxygen level at that time was 17.5 percent.

EXAMPLE 2

The test of Example 1 was repeated, except that two purge gas injectors, each having an outlet 0.28 inches in diameter were used. The modified Reynolds number is now 8,000 while the internal pressure remains $2.7\times10^{-9}$ atm. This represents a practice under the invention. After 15 scf of argon passed into the model tundish, the oxygen level was 6.0 percent.

EXAMPLE 3

The test of Example 1 was repeated, except that the inlet 24 was moved 24 inches away from the opening 18. The modified Reynolds number is again 8,000 while the internal pressure remains $2.7\times10^{-9}$ atm. This represents a practice within the scope of the invention. After 15 scf of argon passed into the model tundish, the oxygen level was 6.1 percent.

EXAMPLE 4

The test of Example 1 was repeated, except that a horizontal baffle was placed 4 inches under the injector purge gas outlet to shorten the jet. The modified Reynolds number is again 8,000 while the internal pressure remains $2.7\times10^{-8}$ atm. This is also within the scope of the invention. After 15 scf of argon passed into the model tundish, the oxygen level was 8.1 percent.

EXAMPLE 5

The test of Example 1 was repeated, except that two injectors 24, each having an outlet 0.28 inches in diameter were used. The inlets were located 24 inches from the opening and the purge gas flow rate was increased to 7.35 scfm. The modified Reynolds number is again 8,000 while the internal pressure is $15\times10^{-8}$ atm. This represents a preferred practice under the invention. After 15 scf of argon passed into the model tundish, the oxygen level was 1.5 percent.

TABLE 1

| Example | 1 | 2 | 3 | 4 | 5 |
|---|---|---|---|---|---|
| $Q_i$, scfm | 2.45 | 2.5 | 2.45 | 2.45 | 7.35 |
| n | 1 | 2 | 1 | 1 | 2 |
| d, in | 0.19 | 0.28 | 0.19 | 0.19 | 0.28 |
| h, in | 12 | 12 | 12 | 4 | 12 |
| L, in | 8 | 8 | 24 | 8 | 24 |
| Re' | 24000 | 8000 | 8000 | 8000 | 8000 |
| P, $10^{-8}$ | 2.7 | 2.7 | 2.7 | 2.7 | 15 |
| $O_2$, pct | 17.5 | 6.0 | 6.1 | 8.1 | 1.5 |
| Air Aspirated, scfm | 12.6 | 1.0 | 1.0 | 1.6 | 0.6 |

The invention can be used recursively when an especially large purge gas inlet is indicated. To achieve the necessary purge gas flow rate an application may require, for example, a 4-inch diameter inlet. Running a 4-inch diameter pipe for any considerable distance would be bulky, inconvenient and expensive. A 1- or 2-inch diameter pipe could be run and fed through a gradual expansion fitting into a 4-inch pipe at the injector use point. However, the expansion section would need to be quite long, nearly 50 inches in the present example, according to R. H. Perry and C. H. Chilton.

Figure 5:
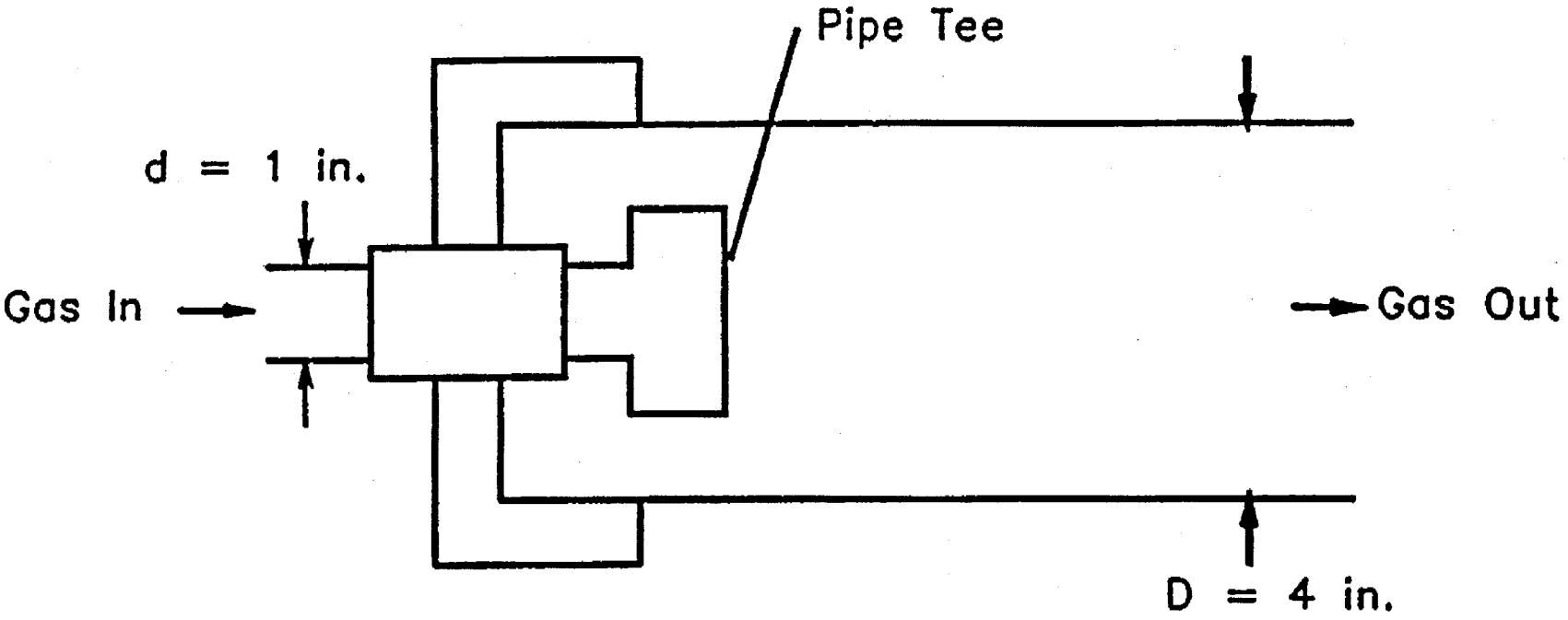
FIG. 5 is a schematic view of a modified form of a purge gas inlet.

The principles of the invention can be used to design a compact device to expand the 1- or 2-inch diameter supply pipe flow to 4 inches, without aspirating ambient air into the purge system. Such a device is shown in FIG. 5. Here, a small diameter supply flow pipe 40, for example of 1-inch diameter, is passed through a cap 42 at one end of a larger diameter pipe 44 and terminates at a tee fitting 46 within the larger pipe 44. This assembly may be considered as an open container with two inert gas inlets, represented by the outlets of the tee fitting 46. The open end at the larger pipe 44 corresponds to the container opening. In this instance, the container diameter and the opening diameter are the same, and no pressure is expected inside the larger pipe 44 from the effects considered in equation (3). However, a significant pressure change may be created along the length of the larger pipe 44 from the frictional effects of the walls of the larger pipe if it is long enough. The outlets of the tee 46 are directed at the internal wall of the large diameter pipe 44. This flow path minimizes the length of the jets formed from the tee outlets to the large pipe internal wall. The length of the large diameter pipe 44 is selected to give the appropriate modified Reynolds number Re"<14,000 which is defined as follows:

$$Re'' = \frac{Q}{n'd'\nu'}\left(\frac{h'}{L'}\right)$$

n' is the number of outlets of said pipe of first diameter d' is the diameter of the outlet of the pipe of first diameter, h' is the distance from the outlet of the pipe of first diameter to the closest interior wall of the pipe of second diameter, and L' is the distance from the outlet of the pipe of first diameter to the outlet of the pipe of second diameter.

ν' is the kinematic viscosity of the ambient gas surrounding the outlet of the large diameter pipe.

The large diameter pipe 44 serves then as the purge gas outlet to the container which is to be purged, and the invention is applied in stages to this larger system.

As noted above, other arrangements can be used for creating a pressure drop between the ambient and the purge gas jets. In addition to friction from pipe walls, baffles (other than the horizontal baffles described above for shortening the jet length), for example, may be used to create a tortuous path within the container, creating a path of high pressure drop. This, and other similar techniques, will tend to lower air aspiration.

As described, the invention accomplishes the use of injectors for the turbulent jets made from simple, inèxpensive and robust equipment while minimizing the aspiration of ambient air into the container processing chamber. Common solid pipe and pipe fittings are used to inject the purge gas into the container. The wall thickness of the pipe used as the jet injector can be adjusted according to the likely service environment to optimize the strength of the turbulent gas injection system. The solid pipe used incurs no strength penalty as is associated with the porous material used to produce a laminar flow. Minor damage to the pipe is inconsequential and repairs can be made inexpensively with little or no special expertise. Further, high flow rates can be obtained with compact equipment.

The invention is particularly useful for purge gas systems for ladles, tundishes and similar containers in steelmaking shops to lower nitrogen and oxygen pickup and to minimize the formation of undesirable inclusions.

Specific features of the invention are shown in one or more of the drawings for convenience only, as each feature may be combined with other features in accordance with the invention. Alternative embodiments will be recognized by those skilled in the art and are intended to be included within the scope of the claims.

I claim:

1. A method of purging a container having an opening and located in an ambient air environment comprising:

providing at least one purge gas injector having an outlet to produce a turbulent purge gas jet at the outlet, and placing the outlet of the at least one injector relative to the opening of the container and an interior wall of the container and making the diameter of the outlet of each of the at least one injector such as to produce a turbulent purge gas let having a modified Reynold's number Re'<14,000, where $$Re' = \frac{Q_i}{n d v_{air}} \left(\frac{h}{L}\right) = Re\left(\frac{h}{L}\right)$$

where:

$Q_i$ is the jet volume flow rate, n is the number of injector outlets, d is the injector outlet diameter, $v_{air}$ is the kinematic viscosity of the ambient air, h is the length of the jet, and L is the distance from the injector outlet to the container opening.

2. The method of claim 1 further comprising the step of supplying the purge gas jet to the container interior from said at least one purge gas injector at a flow rate to produce a positive pressure within the container relative to the ambient air greater than $2\times10^{-8}$ atm above ambient pressure.

3. A method as in claim 1 wherein the container includes a cover and the at least one gas jet injector is mounted in said cover which provides an outlet for the gas injector.

4. A container purging apparatus comprising:

a container having a cover which extends partially across the container to define an opening for communicating with an ambient environment;

at least one purge gas injector that terminates at the top surface of the cover and has an outlet being a passage in said cover for supplying a turbulent gas jet to the container interior located relative to the container opening and an interior wall of the container and having an outlet diameter to produce a modified Reynold's number Re'<14,000, where $$Re' = \frac{Q_i}{n d v_{air}} \left(\frac{h}{L}\right) = Re\left(\frac{h}{L}\right)$$

and where:

$Q_i$ is the jet volume flow rate, n is the number of jet inlets, d is the jet inlet diameter, $v_{air}$ is the kinematic viscosity of the ambient gas, h is the length of the jet, L is the distance from the jet outlet to the container opening.

5. Apparatus as in claim 4 wherein said at least one gas injector comprises a supply pipe of a first diameter and a section of pipe of a second larger diameter, said first pipe having at least one outlet in the interior of said pipe section of second diameter located relative to the outlet of said pipe section of second diameter and an interior wall of said pipe section of said diameter said at least one outlet of said pipe of first diameter having a diameter to produce a modified Reynold's number Re"<14000 where $$Re'' = \frac{Q}{n' d' v'} \left(\frac{h'}{L'}\right)$$

wherein n' is the number of outlets of said pipes of first diameter, d' is the diameter of the outlet of the pipe of first diameter, h' is the diameter for the outlet of the pipe of first diameter to the closest interior wall of the pipe of second diameter, L' is the distance from the outlet of the pipe of the first diameter to the outlet of the pipe of the second diameter, the outlet of said pipe section of second diameter forming the outlet of said at least one injector, and v' is the kinematic viscosity of the ambient gas surrounding the outlet of said pipe section of second diameter the outlet of said pipe section of second diameter forming the outlet of said at least one injector.

* * * * *